US011035629B2

(12) United States Patent
Goto et al.

(10) Patent No.: US 11,035,629 B2
(45) Date of Patent: Jun. 15, 2021

(54) HEAT EXCHANGE APPARATUS

(71) Applicant: DENSO CORPORATION, Kariya (JP)

(72) Inventors: Yousuke Goto, Kariya (JP); Kimio Kohara, Kariya (JP); Satoshi Sakimichi, Kariya (JP); Shogo Kawaguchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 37 days.

(21) Appl. No.: 16/207,366

(22) Filed: Dec. 3, 2018

(65) Prior Publication Data

US 2019/0242662 A1 Aug. 8, 2019

(30) Foreign Application Priority Data

Feb. 5, 2018 (JP) ..... JP2018-18386

(51) Int. Cl.
*F28F 27/02* (2006.01)
*F28F 13/10* (2006.01)
*F28F 9/02* (2006.01)

(52) U.S. Cl.
CPC ..... *F28F 27/02* (2013.01); *F28F 9/02* (2013.01); *F28F 13/10* (2013.01); *F28F 2250/06* (2013.01); *F28F 2250/08* (2013.01)

(58) Field of Classification Search
CPC ..... F28F 27/02; F28F 2250/06; F28F 13/10; F16K 31/36; Y10T 137/6307
See application file for complete search history.

(56) References Cited

U.S. PATENT DOCUMENTS 2,081,510 A * 5/1937 Smart ..... F16K 31/36 137/624.14
2,833,121 A * 5/1958 Dorf ..... F17C 9/02 62/50.2
2,908,485 A * 10/1959 Longwell ..... F28C 3/16 165/101
5,150,749 A * 9/1992 Bergmann ..... F25B 39/00 165/115
2013/0031917 A1* 2/2013 Mackin ..... F28F 17/00 62/80
2013/0327287 A1 12/2013 Kim et al.
2013/0333863 A1 12/2013 Pawellek

FOREIGN PATENT DOCUMENTS

CN 105333213 A 2/2016
DE 3511037 A1 * 10/1986 ..... F28D 7/16
DE 3525742 A1 * 1/1987 ..... A01G 25/162
DE 102011001090 A1 9/2012
DE 102012113111 A1 12/2013
(Continued)

*Primary Examiner* — Eric S Ruppert
(74) *Attorney, Agent, or Firm* — Harness, Dickey & Pierce, P.L.C.

(57) ABSTRACT

A heat exchange apparatus includes a heat exchanger through which a heat exchange medium flows inside, a fluid transport device that causes the heat exchange medium to flow, and a flow path through which the heat exchange medium flows. The heat exchange apparatus includes a flow rate controller configured to increase or decrease the flow rate of the heat exchange medium flowing through the flow path, and a driving part that drives the flow rate controller by receiving a force from the flow of the heat exchange medium flowing through the flow path.

15 Claims, 13 Drawing Sheets

(56) References Cited

FOREIGN PATENT DOCUMENTS

| | | | | | |
|---|---|---|---|---|---|
| EP | 0057672 | A2 | * | 8/1982 | ..... F16K 31/36 |
| GB | 846950 | A | * | 9/1960 | ..... G21C 15/02 |
| GB | 2125936 | A | * | 3/1984 | ..... D06F 39/028 |
| JP | H07-080427 | A | | 3/1995 | |
| JP | 2006-336974 | A | | 12/2006 | |
| JP | 2007-202244 | A | | 8/2007 | |
| JP | 2007-275824 | A | | 10/2007 | |
| JP | 2015-040662 | A | | 3/2015 | |
| JP | 2015-045478 | A | | 3/2015 | |
| JP | 2015-175569 | A | | 10/2015 | |
| JP | 2016-217564 | A | | 12/2016 | |
| JP | 2016-223395 | A | | 12/2016 | |
| JP | 2016-223396 | A | | 12/2016 | |
| JP | 2017-026285 | A | | 2/2017 | |
| JP | 2017-028957 | A | | 2/2017 | |

* cited by examiner

HEAT EXCHANGE APPARATUS

CROSS REFERENCE TO RELATED APPLICATION

This application is based on Japanese Patent Application No. 2017-111958 filed on Jun. 6, 2017 and Japanese Patent Application No. 2018-18386 filed on Feb. 5, 2018, the descriptions of which are hereby incorporated by reference.

TECHNICAL FIELD

The present disclosure relates to a heat exchange apparatus.

BACKGROUND ART

There is a heat exchanger in which a turbulence is caused by pulsating a fluid for heat exchange to enhance the efficiency of heat exchange.

SUMMARY

The heat exchange apparatus disclosed herein includes: a heat exchanger through which a heat exchange medium flows; a fluid transport device that causes the heat exchange medium to flow through the heat exchanger; a flow path through which the heat exchange medium flows, the flow path connecting the heat exchanger and the fluid transport device; a flow rate controller provided in the flow path to raise or lower a flow velocity of the heat exchange medium flowing through the flow path; and a driving part provided in the flow path to drive the flow rate controller by a flow of the heat exchange medium flowing through the flow path.

DETAILED DESCRIPTION

Figure 1:
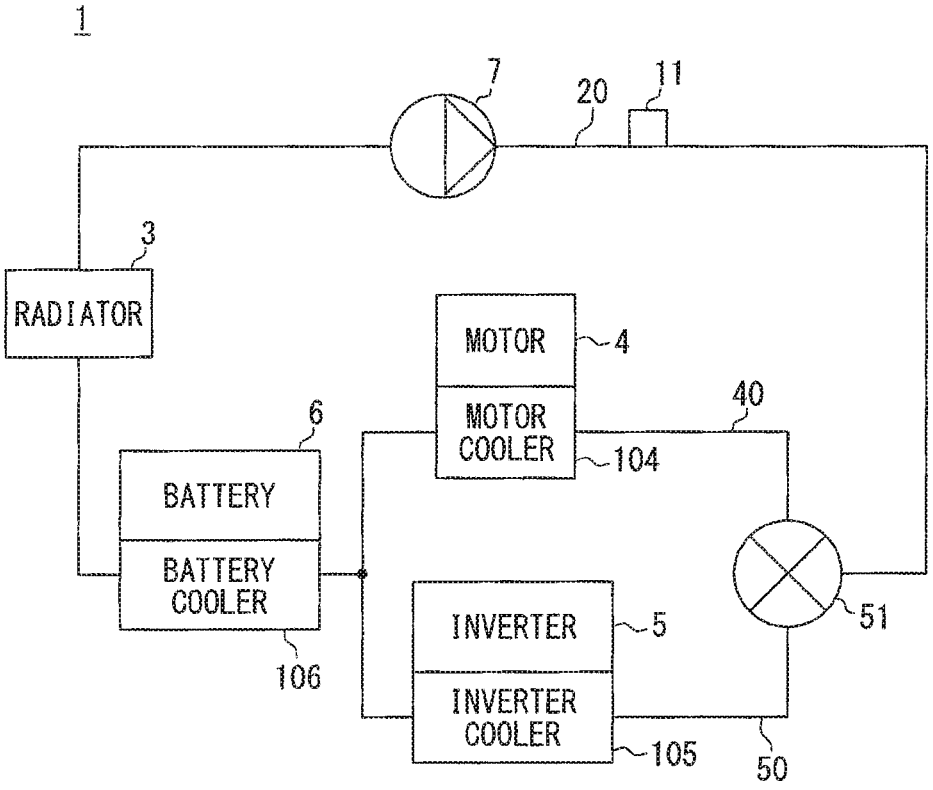
FIG. 1 is a diagram illustrating a heat exchange apparatus.

Hereinafter, plural embodiments will be described with reference to the drawings. In some embodiments, parts that are functionally and/or structurally corresponding and/or associated are given the same reference numerals, or reference numerals with different hundred digit or more digits. For corresponding parts and/or associated parts, reference can be made to the description of other embodiments.

First Embodiment

In FIG. 1, a heat exchange apparatus 1 has a radiator 3, a motor 4, an inverter 5, a battery 6, and a circulation pump 7, which are connected by a flow path. The heat exchange apparatus 1 is mounted on a vehicle such as an electric car. The heat exchange apparatus 1 circulates cooling water, which is a heat exchange medium, to exchange heat between a heat source, e.g., a heat generating component, and the cooling water. That is, the heat exchange apparatus 1 performs cooling or heating of an object by heat exchange. The motor 4, the inverter 5, and the battery 6 are electronic components used for driving the vehicle.

The heat exchange apparatus 1 includes three flow paths for the cooling water, that is, a common flow path 20, a motor flow path 40, and an inverter flow path 50, which are connected to annularly circulate the cooling water. The motor flow path 40 and the inverter flow path 50 are parallel to each other. In other words, the cooling water flowing through the common flow path 20 flows through one of the motor flow path 40 and the inverter flow path 50, and returns to the common flow path 20 to circulate again.

The heat exchange apparatus 1 is provided with the common flow path 20 which is a flow path for the cooling water. The circulation pump 7 is provided in the common flow path 20. The circulation pump 7 is an electric water pump capable of electrically controlling the output. The circulation pump 7 circulates the cooling water at a constant flow rate. In other words, the circulation pump 7 circulates the cooling water as a steady flow. The circulation pump 7 provides a fluid transport device. However, the heat exchange apparatus 1 is not limited to perform heat exchange using a liquid such as cooling water, and may be an apparatus that circulates gas such as air to perform heat exchange. In this case, a blower or the like can be used as the fluid transport device.

A water temperature sensor 11 is provided in the common flow path 20. The water temperature sensor 11 is disposed in the vicinity of the circulation pump 7. The water temperature sensor 11 is a sensor for measuring the temperature of the cooling water immediately after being pumped out from the circulation pump 7. The circulation amount of the cooling water delivered by the circulation pump 7 is controlled based on the temperature of the water temperature sensor 11. When the temperature of the water temperature sensor 11 is high, the circulation amount is increased. When the temperature of the water temperature sensor 11 is low, the circulation amount is decreased.

The radiator 3 is disposed in the common flow path 20. Cooling water flows inside the radiator 3. The radiator 3 is a heat exchanger for cooling the cooling water by exchanging heat between the cooling water and air. The radiator 3 receives traveling wind generated as the vehicle travels. The radiator 3 receives cooling air from a radiator fan provided to face the radiator 3.

The battery 6 is provided in the common flow path 20 via a battery cooler 106. The battery 6 is a heat source that radiates heat to the outside. The battery 6 is a device that stores electric power as a power source for driving electric parts such as the motor 4. The battery 6 is a lithium ion battery. Cooling water flows inside the battery cooler 106. The battery cooler 106 exchanges heat between the cooling water and the battery 6 to lower the temperature of the battery 6. In other words, the battery cooler 106 functions as a heat exchanger for cooling the battery 6.

When the outside air temperature is low, the battery cooler 106 exchanges heat between the battery 6 and the cooling water to raise the temperature of the battery 6, since the temperature of the cooling water is raised by heat from the other heat generating component. In other words, the battery cooler 106 functions as a heat exchanger for heating the battery 6.

The motor 4 is a heat source that radiates heat to the outside. The motor 4 functions as a power source for converting electric power into a driving power to drive the electric car. A motor cooler 104 is connected to the motor 4. The motor cooler 104 is connected to the common flow path 20 via the motor flow path 40. Cooling water flows inside the motor cooler 104. The motor cooler 104 performs heat exchange between the cooling water and the motor 4 to lower the temperature of the motor 4. In other words, the motor cooler 104 functions as a heat exchanger for cooling the motor 4. The motor cooler 104 corresponds to a first heat exchanger. The motor flow path 40 corresponds to a first flow path.

The inverter 5 is a heat source that emits heat to the outside. The inverter 5 is a device for converting direct current into alternating current for driving the motor 4. The inverter 5 controls the amount and frequency of current flowing to the motor 4 when the direct current is converted to the alternating current. An inverter cooler 105 is connected to the inverter 5. The inverter cooler 105 is connected to the common flow path 20 via the inverter flow path 50. Cooling water flows inside the inverter cooler 105. The inverter cooler 105 performs heat exchange between the cooling water and the inverter 5 to lower the temperature of the inverter 5. In other words, the inverter cooler 105 functions as a heat exchanger for cooling the inverter 5. The inverter cooler 105 corresponds to a second heat exchanger. The inverter flow path 50 corresponds to a second flow path.

A unit of the motor 4 and the motor cooler 104 is connected in parallel to a unit of the inverter 5 and the inverter cooler 105. In other words, the cooling water flowing through the common flow path 20 flows through one of the motor cooler 104 and the inverter cooler 105 and returns to the common flow path 20 to circulate again. The inverter 5 may be a power control unit integrally formed with a device, such as a step-up converter, used for controlling the motor 4.

The heat exchanger 3, 104, 105, 106 is a parallel flow type heat exchanger in which plural flow paths are formed for the cooling water in parallel between two headers. The heat exchanger 3, 104, 105, 106 includes flat pipes having a small passage area as the passage for the cooling water. A fluid flowing through the flat pipe with the small inner diameter tends to flow in a laminar flow state since the Reynolds number is small. The heat exchanger 3, 104, 105, 106 has inner fins inside the piping, through which the cooling water circulates, for increasing the contact area with the cooling water. The heat exchanger 3, 104, 105, 106 is not limited to the parallel flow type heat exchanger. For example, a fin tube type heat exchanger or a serpentine type heat exchanger may be used.

An open/close valve 51 is provided at a connection between the common flow path 20, the motor flow path 40, and the inverter flow path 50. Details of the open/close valve 51 will be described later. The open/close valve 51 has a function of periodically decelerating the flow of the cooling water to repeatedly raise and lower the flow velocity. In other words, the open/close valve 51 has a function of generating a pulsating flow. In other words, the open/close valve 51 converts the cooling water from a steady flow to a pulsating flow. The open/close valve 51 has a switching function to switch the cooling water to flow into the motor flow path 40 or the inverter flow path 50.

The flow of the cooling water in the heat exchange apparatus 1 will be described. The cooling water delivered from the circulation pump 7 flows through the common flow path 20 in a steady flow state. In the common flow path 20, the temperature of the cooling water is measured by the water temperature sensor 11. Thereafter, the cooling water flows into the open/close valve 51.

The open/close valve 51 generates a pulsating flow and switches the flow paths. That is, the cooling water is converted from the steady flow to the pulsating flow, and alternately flows through the motor flow path 40 and the inverter flow path 50. No component that impedes the flow of the cooling water is arranged in the flow path from the open/close valve 51 to the motor cooler 104 or the inverter cooler 105. In other words, the cooling water converted into the pulsating flow by the open/close valve 51 firstly flows into the motor cooler 104 or the inverter cooler 105.

The pulsating flow of the cooling water flowing into the motor cooler 104 or the inverter cooler 105 flows as turbulent flow rather than laminar flow. In other words, the cooling water is not a laminar flow that is regularly flowing on a streamline, but a turbulent flow that moves irregularly in terms of time and space. As the turbulence increases, the heat transfer is promoted, because the cooling water heat-exchanged with the pipe moves away from the pipe, and the cooling water not heat-exchanged with the pipe approaches the pipe. In other words, since the heat distribution of the cooling water flowing through the piping tends to be uniform irrespective of the distance from the pipe, the heat transfer efficiency is improved. Therefore, it is possible to improve the heat exchange efficiency in the motor cooler 104 and the inverter cooler 105.

The cooling water that has passed through the motor cooler 104 or the inverter cooler 105 flows into the common flow path 20, and performs heat exchange in the order of the battery cooler 106 and the radiator 3, after the cooling water exchanges heat with the motor cooler 104 or the inverter cooler 105. Due to the water passage resistance in the cooler and the piping, the cooling water is under changing from the pulsating flow to the steady flow. However, while the cooling water flows through the battery cooler 106 and the radiator 3 for heat exchange, the high heat exchange efficiency is partially maintained as a turbulent flow. The contribution of improving the heat exchange efficiency due to the pulsating flow is the largest at the motor cooler 104 and the inverter cooler 105. The contribution of improving the heat exchange efficiency due to the pulsating flow is secondary largest at the battery cooler 106. The contribution of improving the heat exchange efficiency due to the pulsating flow is the smallest at the radiator 3. That is, the contribution of improving the heat exchange efficiency due to the pulsating flow becomes larger as the distance from the open/close valve 51, which is a pulsating flow generating device, is smaller. The contribution becomes smaller as the distance from the open/close valve 51 becomes larger.

The temperature of cooling water is lowered by heat exchange with the air in the radiator 3, and the cooling water is returned to the circulation pump 7. The cooling water returned to the circulation pump 7 is again sent out by the circulation pump 7 in a steady flow.

Figure 2:
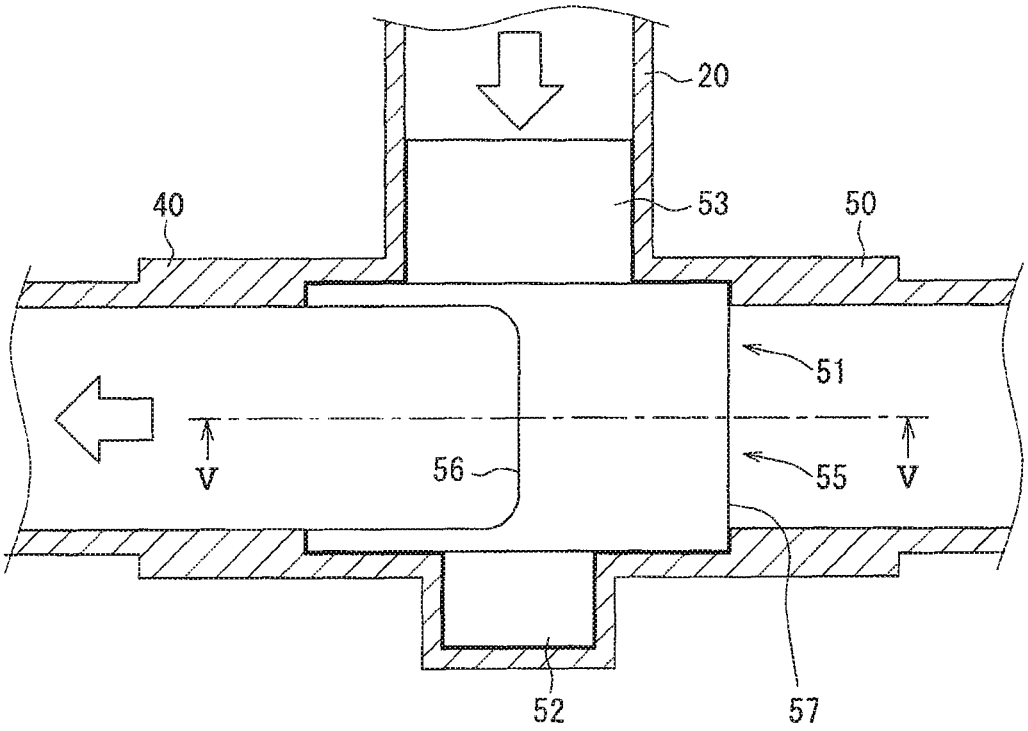
FIG. 2 is a view illustrating an open/close valve attached to a piping.

In FIG. 2, the open/close valve 51 is provided inside a pipe forming a flow path for the cooling water. The open/close valve 51 is provided inside a pipe where three flow paths intersect, that is, at a connection among the common flow path 20, the motor flow path 40, and the inverter flow path 50. The motor flow path 40 and the inverter flow path 50 are provided to oppose each other and to be extended in the opposite directions. The flow path area is substantially the same among the piping forming the common flow path 20, the piping forming the motor flow path 40, and the piping forming the inverter flow path 50.

Figure 3:
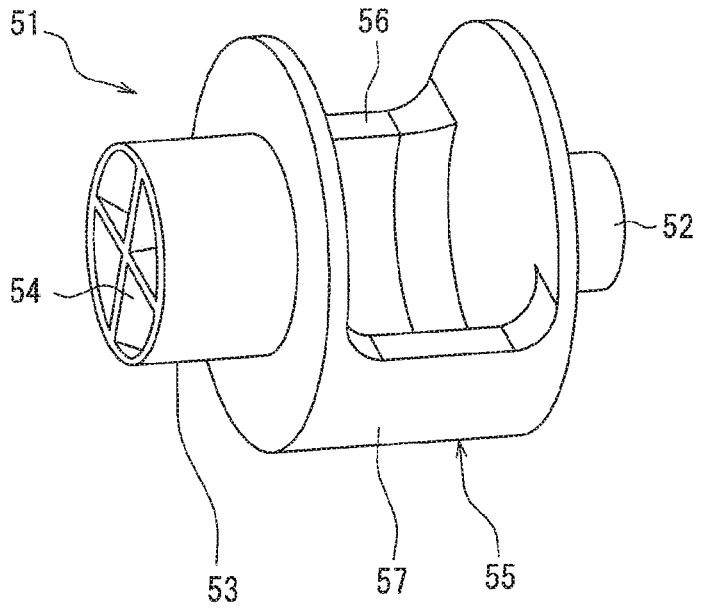
FIG. 3 is a perspective view illustrating the open/close valve.

In FIG. 3, the open/close valve 51 has a bottomed cylindrical shape. The open/close valve 51 is made of resin material. The open/close valve 51 has a protruding portion 52 protruding outward from the bottom surface. The protruding portion 52 functions as a center axis when the open/close valve 51 rotates. Cooling water flows into the open/close valve 51.

The open/close valve 51 has a small diameter portion 53 having a small inner diameter on the upstream side in the flow of the cooling water. The inner diameter of the small diameter portion 53 is smaller than the inner diameter of the pipe forming the common flow path 20. That is, the flow path area of the small diameter portion 53 is smaller than the flow path area of the pipe forming the common flow path 20. The open/close valve 51 has a large diameter portion 55 having a large inner diameter on the downstream side in the flow of the cooling water. The inner diameter of the large diameter portion 55 is larger than the inner diameter of the small diameter portion 53. That is, the flow path area of the large diameter portion 55 is larger than the flow path area of the small diameter portion 53. In other words, the flow path for the cooling water inside the open/close valve 51 is formed of two cylinders having different inner diameters, i.e., the small diameter portion 53 and the large diameter portion 55.

The small diameter portion 53 functions as an inlet for the cooling water flowing into the open/close valve 51. The cooling water flowing into the small diameter portion 53 flows to the large diameter portion 55. The driving part 54 is housed inside the small diameter portion 53. The interior of the small diameter portion 53 is divided into four regions by the driving part 54.

The large diameter portion 55 has a valve opening 56 to communicate the inside and the outside of the open/close valve 51 with each other. The large diameter portion 55 includes a valve lid 57 having an arc shape in the cross section. The valve lid 57 forms a wall surface of the large diameter portion 55. In other words, the valve opening 56 is formed in a half region of the large diameter portion 55, and the valve lid 57 is formed in a half region of the large diameter portion 55. The valve opening 56 functions as an outlet for the cooling water flowing in the open/close valve 51. The valve opening 56 increases the flow of the cooling water to accelerate. The valve lid 57 limits the flow of the cooling water to decelerate. In other words, the open/close valve 51 functions as a flow rate controller that performs acceleration and deceleration of the cooling water using the valve opening 56 and the valve lid 57.

The open/close valve 51 corresponding to a flow rate controller is integrally provided with the driving part 54. In other words, the driving part 54 is provided as a part of the open/close valve 51. The open/close valve 51 and the driving part 54 may be separable from each other. That is, the open/close valve 51 and the driving part 54 may be provided as separate components, and set into one-piece component to cooperate using a connecting component such as a gear. Alternatively, the open/close valve 51 and the driving part 54 may be provided as separate parts, and be combined by, for example, screwing.

Figure 4:
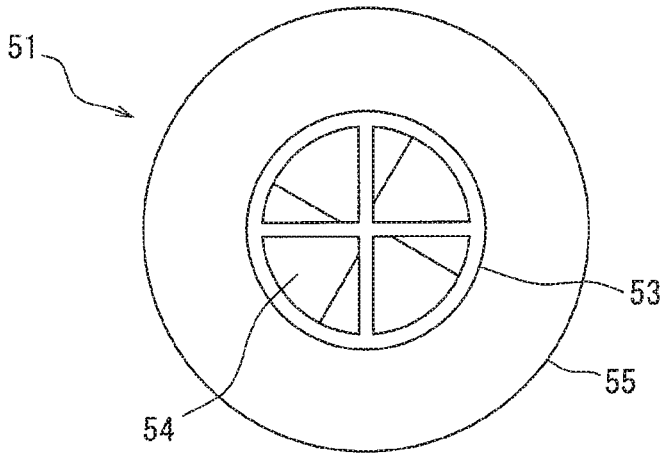
FIG. 4 is a front view illustrating the open/close valve.

In FIG. 4, the driving part 54 includes four impellers angled with respect to the flowing direction of the cooling water. In other words, the driving part 54 is a rotating body in which plate members are spirally formed around the rotation axis. In other words, the driving part 54 has a water wheel structure (that is, an impeller structure, a turbine structure). The driving part 54 receives the fluid energy which is a force of the flow of the cooling water flowing through the open/close valve 51 (specifically, converts the fluid energy into torque without using external power) to rotate the open/close valve 51 integrally formed with the driving part 54. That is, when the cooling water flows with high speed, the driving part 54 rotates with high speed, and the open/close valve 51 integrally formed with the driving part 54 also rotates at high speed. When the cooling water flows with low speed, the driving part 54 rotates with low speed, and the open/close valve 51 integrally formed with the driving part 54 also rotates at low speed.

When the angle of the plate member of the driving part 54 with respect to the flow direction is increased, the force of the flow is increased, and the open/close valve 51 rotates at high speed. When the length of the plate member of the driving part 54 is made longer along the flow direction, the force of the flow is increased by more contact with the cooling water, and the open/close valve 51 rotates stably and quickly. Therefore, the rotation speed of the open/close valve 51 can be controlled by the form of the plate member of the driving part 54. It is preferable to adjust the driving part 54 so that the frequency of the pulsating flow becomes about 2 Hz.

In FIG. 2, the protruding portion 52 is housed in a bulging portion of the pipe, which forms a flow path for the cooling water, bulging from the inside to the outside. The small diameter portion 53 is connected into the common flow path 20. The protruding portion 52 and the small diameter portion 53 of the open/close valve 51 are supported by the respective pipes to be rotatable inside the pipes.

The large diameter portion 55 opens and closes the inlet opening of the motor flow path 40 or the inlet opening of the inverter flow path 50. The large diameter portion 55 is housed in the pipe in a state where the outer edge of the large diameter portion 55 is fitted with a recess defined in the pipe. The opening height of the valve opening 56 is substantially equal to the inner diameter of the pipe. That is, in a state where the open/close valve 51 is housed in the recess, the cooling water flowing out from the valve opening 56 smoothly flows into the piping without steps. The height of the valve lid 57 is larger than the inner diameter of the pipe. That is, in a state where the open/close valve 51 is housed in the recess, the cooling water is prevented from flowing backward through a gap between the valve lid 57 and the pipe.

The open/close valve 51 switches the cooling water to flow through the motor flow path 40 or the inverter flow path 50. That is, when the flow path to the motor flow path 40 is opened, the open/close valve 51 closes the flow path to the inverter flow path 50. The open/close valve 51 opens the flow path to the inverter flow path 50 when the flow path to the motor flow path 40 is closed. In other words, the open/close valve 51 switches the two flow paths, so that the cooling water flows into the motor flow path 40 and the inverter flow path 50 at different timings.

Figure 5:
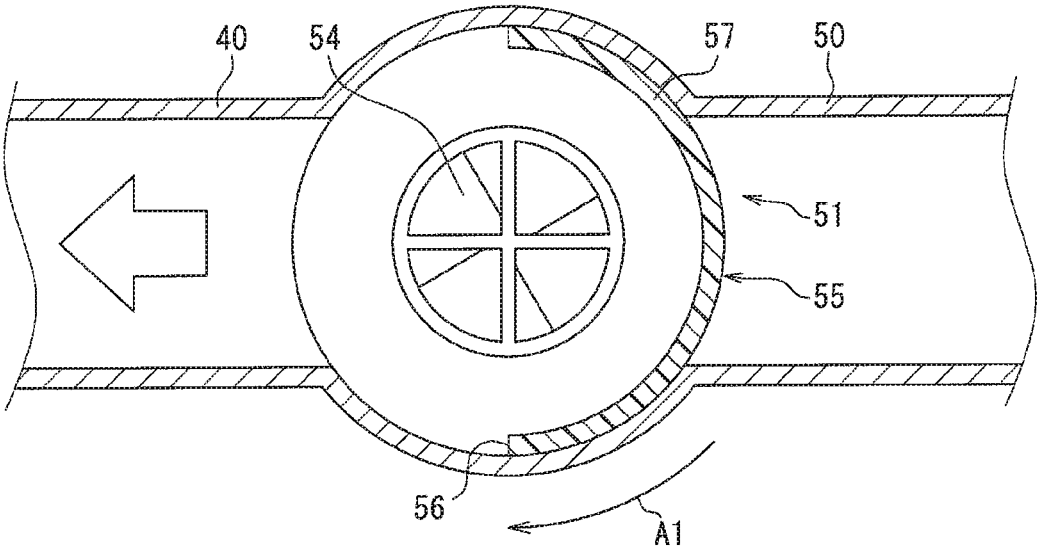
FIG. 5 is a cross-sectional view taken along a line V-V of FIG. 2.

In FIG. 5, when the inlet opening of the pipe and the valve opening 56 overlap with each other, the open/close valve 51 is open. That is, the motor flow path 40 is in the open state. When the inlet opening of the pipe and the valve lid 57 overlap with each other, the open/close valve 51 is closed. That is, the inverter flow path 50 is in the closed state. A slight gap may provided between the valve lid 57 and the pipe, but there is substantially no clearance. A large clearance may be secured between the valve lid 57 and the pipe, so that a certain amount of flow can be secured even in the closed state. The cooling water flows through the driving part 54 to rotate the open/close valve 51. That is, the open/close valve 51 rotates in the arrow direction A1 by receiving the force of the flow of the cooling water flowing in the direction from the back side to the front side in the drawing.

Figure 6:
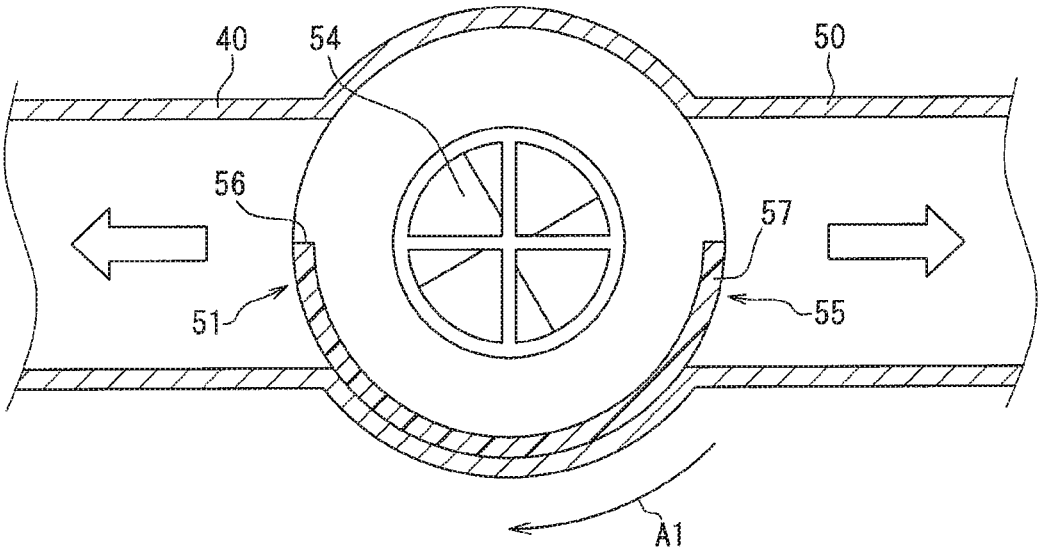
FIG. 6 is a cross-sectional view illustrating the open/close valve in a throttle state.

In FIG. 6, when both the valve opening 56 and the valve lid 57 overlap the inlet opening, a throttle state is defined in which the cooling water that can pass through the open/close valve 51 is restricted. In other words, the flow path area is reduced in comparison with the open state. In other words, the flow path area is increased compared with the closed state. The open/close valve 51 receives the force of the flow of the cooling water and rotates in the arrow direction A1, thereby gradually reducing the flow path area of the motor flow path 40, and gradually increasing the flow path area of the inverter flow path 50. When the motor flow path 40 is in the closed state, the inverter flow path 50 is in the open state. Thereafter, the open/close valve 51 continues to rotate in the arrow direction A1 to gradually increase the flow path area of the motor flow path 40 and to gradually decrease the flow path area of the inverter flow path 50.

When the open/close valve 51 is in the open state, the amount of cooling water that can flow into the inlet opening is increased as compared with the closed state. That is, after passing through the inlet opening, the speed of the cooling water is accelerated, and the cooling water flows in a state of one unit. When the open/close valve 51 is in the closed state, the amount of cooling water that can flow into the inlet opening decreases as compared with the open state. That is, after passing through the inlet opening, the speed of the cooling water flowing through the inside of the pipe is reduced. When the open/close valve 51 is in the throttle state, the cooling water is accelerated as the passage area of the open/close valve 51 is increased. In contrast, as the passage area decreases, the cooling water is decelerated.

The open/close valve 51 rotates inside the pipe, thereby periodically switching the open state, the throttle state, and the closed state from one another at the inlet opening of each flow path. That is, the open/close valve 51 periodically changes the flow velocity of the cooling water flowing through each flow path to generate a pulsating flow.

The open/close valve 51 is rotated by receiving a force of the flow of the cooling water delivered by the circulation pump 7 and passing through the driving part 54. When the circulation pump 7 is stopped, the cooling water does not flow through the driving part 54, and the open/close valve 51 does not rotate and is stopped without receiving the force of the flow.

When the output of the circulation pump 7 is high, the flow speed of the cooling water flowing through the flow path is increased, so that the flow of the cooling water flowing through the driving part 54 also becomes faster. Therefore, the rotation of the open/close valve 51 also becomes faster, and the switching of the flow path between the motor flow path 40 and the inverter flow path 50 is also performed quickly. That is, the frequency of the pulsating flow generated by the open/close valve 51 is raised. On the other hand, when the output of the circulation pump 7 is low, the flow speed of the cooling water flowing through the flow path becomes slow, so that the flow of the cooling water flowing through the driving part 54 also becomes slow. Therefore, the rotation of the open/close valve 51 becomes slow, and the switching of the flow path between the motor flow path 40 and the inverter flow path 50 is also performed slowly. That is, the frequency of the pulsating flow generated by the open/close valve 51 is lowered. In this way, the open/close valve 51 is driven to open or close by the flow speed of the cooling water actually flowing through the flow path. In other words, the open/close valve 51 is driven in conjunction with the flow of cooling water in the flow path.

The flow direction of the cooling water is switched by the open/close valve 51 between the two flow paths, i.e., the motor flow path 40 and the inverter flow path 50. Therefore, the phase of the pulsating flow is shifted between the flow in the motor flow path 40 and the flow in the inverter flow path 50. That is, when the motor flow path 40 is in the open state, the inverter flow path 50 is in the closed state. On the other hand, when the motor flow path 40 is in the closed state, the inverter flow path 50 is in the open state. Therefore, the pulsating flow flowing through the motor flow path 40 and the pulsating flow flowing through the inverter flow path 50 have opposite phases where the cycle is shifted from each other by a half of the cycle.

In contrast, in a comparative example, in order to generate a pulsating flow, the drive motor of the pump is controlled to have various rotational speeds, or plural pumps are provided and controlled to have different rotational speeds. In these cases, a complicated control is required to generate a pulsating flow. Further, in order to generate a pulsating flow, a complicated structure such as wiring for control is required.

The heat exchange apparatus disclosed herein includes: a heat exchanger through which a heat exchange medium flows; a fluid transport device that causes the heat exchange medium to flow through the heat exchanger; a flow path through which the heat exchange medium flows, the flow path connecting the heat exchanger and the fluid transport device; a flow rate controller provided in the flow path to raise or lower a flow velocity of the heat exchange medium flowing through the flow path; and a driving part provided in the flow path to drive the flow rate controller by a flow of the heat exchange medium flowing through the flow path.

According to the disclosed heat exchange apparatus, the driving part provided inside the flow path receives a force from the flow of the heat exchange medium to drive the flow rate controller to periodically increase or decrease the flow speed of the heat exchange medium. Thereby, it is possible to improve the heat exchange efficiency of the heat exchanger with a simple structure without wirings for controlling the driving part.

According to the embodiment described above, since the open/close valve 51 has the function of generating a pulsating flow, it is possible to improve the heat exchange efficiency without changing the shape and material of the heat exchanger. Alternatively, since the heat exchange efficiency is improved by the action of the pulsating flow, the heat exchanger can be downsized while maintaining the heat exchange ability.

The open/close valve 51 has a function of generating a pulsating flow. Therefore, it is possible to switch the flow path and to generate the pulsating flow for the cooling water with one component. Therefore, the number of components can be reduced, and the heat exchange apparatus 1 can be made smaller and lighter. In other words, a pulsating flow can be generated with a simple structure.

The open/close valve 51 is provided between the circulation pump 7 and the motor cooler 104 or the inverter cooler 105, and is positioned closer to the motor cooler 104 and the inverter cooler 105 than the circulation pump 7. Therefore, the cooling water smoothly circulates as a steady flow from the circulation pump 7 to the open/close valve 51, and it is possible to secure a large flow rate at the piping where the high heat exchange efficiency is not required.

The driving part 54 is provided inside the flow path and receives a force from the flow of the cooling water to drive the open/close valve 51. Therefore, it is unnecessary to provide a driving motor, wiring, etc. in order to control the open/close valve 51. Therefore, the heat exchange apparatus 1 can be downsized. In addition, since there is no need to control the open/close valve 51, the control flow can be simplified.

The pulsating flow flowing through the motor cooler 104 and the pulsating flow flowing through the inverter cooler 105 have different phases different from each other. In other words, when the cooling water does not flow into the motor cooler 104, the cooling water flows into the inverter cooler 105. On the other hand, when the cooling water does not flow into the inverter cooler 105, the cooling water flows into the motor cooler 104. Therefore, it is easy to maintain the flow rate of the cooling water flowing through the heat exchange apparatus 1 as a whole. Therefore, since the maximum flow rate flowing through the entire flow path does not fluctuate largely, it is unnecessary to finely control the output of the circulation pump 7. In addition, it is possible to prevent or reduce the impact caused by the water hammer effect accompanying switching of the flow path. Therefore, it is possible to prevent breakage of the open/close valve 51 and the piping in the vicinity of the open/close valve 51 caused by the water hammering effect.

The flow path area is substantially the same among the piping forming the common flow path 20, the piping forming the motor flow path 40, and the piping forming the inverter flow path 50. Therefore, substantially the same amount of cooling water can be circulated between the state in which the motor flow path 40 is opened and the state in which the inverter flow path 50 is opened. Therefore, it is possible to reduce the pressure fluctuation accompanying switching of the flow path and to prevent breakage of the open/close valve 51 and the piping in the vicinity of the open/close valve 51 caused by the water hammering effect.

There is no situation that the cooling water does not flow through the motor cooler 104 nor the inverter cooler 105. In other words, when the circulation pump 7 is active, the cooling water flows into the motor cooler 104 or/and the inverter cooler 105. That is, the open/close valve 51 does not simultaneously close the motor flow path 40 and the inverter flow path 50. For this reason, it is possible to make the cooling water to circulate somewhere during operation of the circulation pump 7. Therefore, the flow of the cooling water can be restricted from being interrupted, and the power for rotating the driving part 54 can be restricted from being run out.

The motor cooler 104, the inverter cooler 105, and the battery cooler 106 cool electronic components. Due to the miniaturization, it is usually difficult to secure a large contact area for cooling the electronic components. According to the embodiment, it is possible to efficiently cool the electronic components even in a small space. Therefore, the entire vehicle including the heat exchange apparatus 1 can be reduced in size and weight.

The protruding portion 52 is housed in the bulging portion bulging outward from the inside of the pipe for the cooling water. Therefore, the open/close valve 51 and components connected to the open/close valve 51 are not exposed to outside from the piping. Therefore, it is possible to prevent the cooling water from leaking from the piping around the protruding portion 52.

The valve lid 57 may have an opening or slit through which the cooling water can pass. According to this, even when the valve lid 57 closes the inlet opening, the cooling water can flow through the opening or the slit. Therefore, it is possible to more reliably prevent the power to rotate the driving part 54 from being lost by shutting off the flow of the cooling water. In other words, it is possible to cool the heat exchanger with high reliability.

Second Embodiment

This embodiment is a modification of the preceding embodiment. In this embodiment, three devices functioning as heat exchangers are arranged in parallel, and a pulsating flow of cooling water is supplied to each of the heat exchangers.

Figure 7:
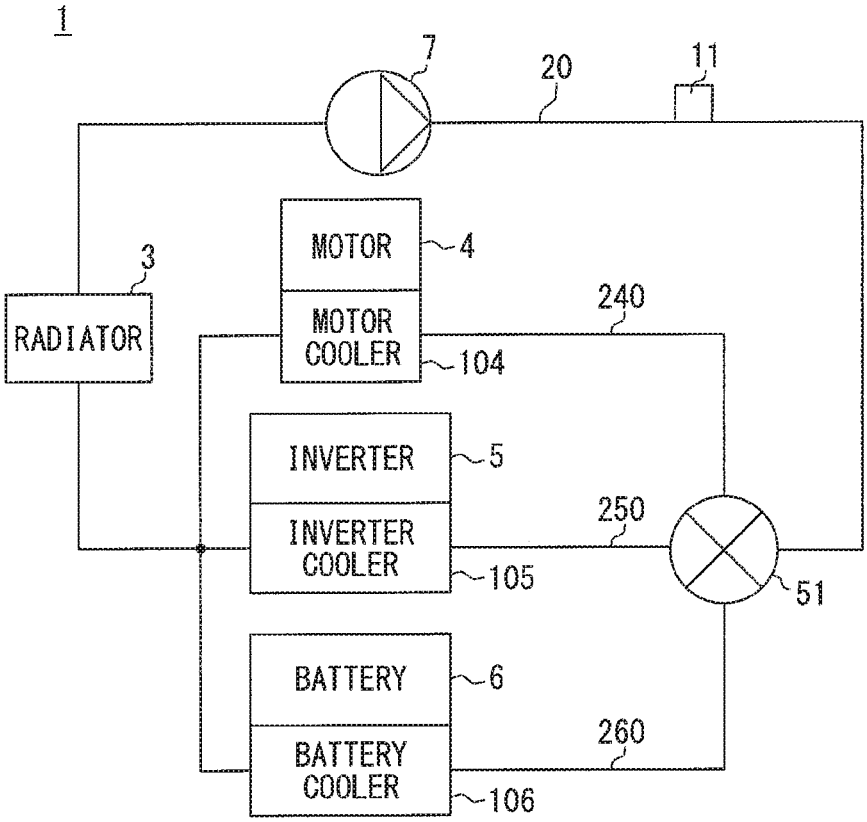
FIG. 7 is a diagram illustrating a heat exchange apparatus according to a second embodiment.

In FIG. 7, the motor 4 and the motor cooler 104, the inverter 5 and the inverter cooler 105, and the battery 6 and the battery cooler 106 are connected in parallel with each other. The motor cooler 104 is connected to the common flow path 20 via the motor flow path 240. The inverter cooler 105 is connected to the common flow path 20 via the inverter flow path 250. The battery cooler 106 is connected to the common flow path 20 via the battery flow path 260. The piping forming the motor flow path 240, the piping forming the inverter flow path 250, and the piping forming the battery flow path 260 are smaller in the flow path area than the piping forming the common flow path 20. That is, the inner diameter of the piping forming each of the flow paths 240, 250, 260 is smaller than the inner diameter of the piping forming the common flow path 20.

The heat exchange apparatus 1 has four channels, that is, the common flow path 20, the motor flow path 240, the inverter flow path 250, and the battery flow path 260, for the cooling water, which are connected annularly to circulate the cooling water. The motor flow path 240, the inverter flow path 250, and the battery flow path 260 are in parallel with each other. In other words, the cooling water flowing through the common flow path 20 flows through one of the motor flow path 240, the inverter flow path 250, and the battery flow path 260 and returns to the common flow path 20 to circulate again.

The open/close valve 51 is provided at the connection point among the common flow path 20, the motor flow path 240, the inverter flow path 250 and the battery flow path 260, upstream of the motor cooler 104, the inverter cooler 105, and the battery cooler 106. The open/close valve 51 has a function of generating a pulsating flow by periodically decelerating the flow of the cooling water to repeatedly increase and decrease the flow velocity. In other words, the open/close valve 51 converts the cooling water from a steady flow into a pulsating flow. The open/close valve 51 has a switching function to switch the cooling water to flow into one of the three flow paths, i.e., the motor flow path 240, the inverter flow path 250, and the battery flow path 260.

The open/close valve 51 is rotated in response to the force of the flow of the cooling water in the driving part 54 to sequentially set the open state, the throttle state and the closed state with respect to the three flow paths, i.e., the motor flow path 240, the inverter flow path 250, and the battery flow path 260. Thereby, the flow rate of the cooling water flowing in each flow path is periodically changed. In other words, the open/close valve 51 supplies a pulsating flow of cooling water to the three flow paths, i.e., the motor flow path 240, the inverter flow path 250, and the battery flow path 260.

According to the present embodiment, a pulsating flow of the cooling water can be sent to the three heat exchangers, i.e., the motor cooler 104, the inverter cooler 105, and the battery cooler 106. Therefore, it is possible to uniformly improve the heat exchange efficiency for the plural heat exchangers.

The piping forming the motor flow path 240, the piping forming the inverter flow path 250, and the piping forming the battery flow path 260 are smaller in the flow path area than the piping forming the common flow path 20. Therefore, a shortage can be prevented in the supply of the cooling water to the heat exchangers, i.e., the motor cooler 104, the inverter cooler 105, and the battery cooler 106. In other words, it is easy to stably supply the cooling water to each heat exchanger.

The number of heat exchangers to be cooled is not limited to three. That is, four or more heat exchangers may be arranged in parallel.

Third Embodiment

This embodiment is a modification of the preceding embodiment. In this embodiment, four devices functioning as heat exchangers are arranged in series, and a pulsating flow of cooling water is supplied to each of the heat exchangers.

Figure 8:
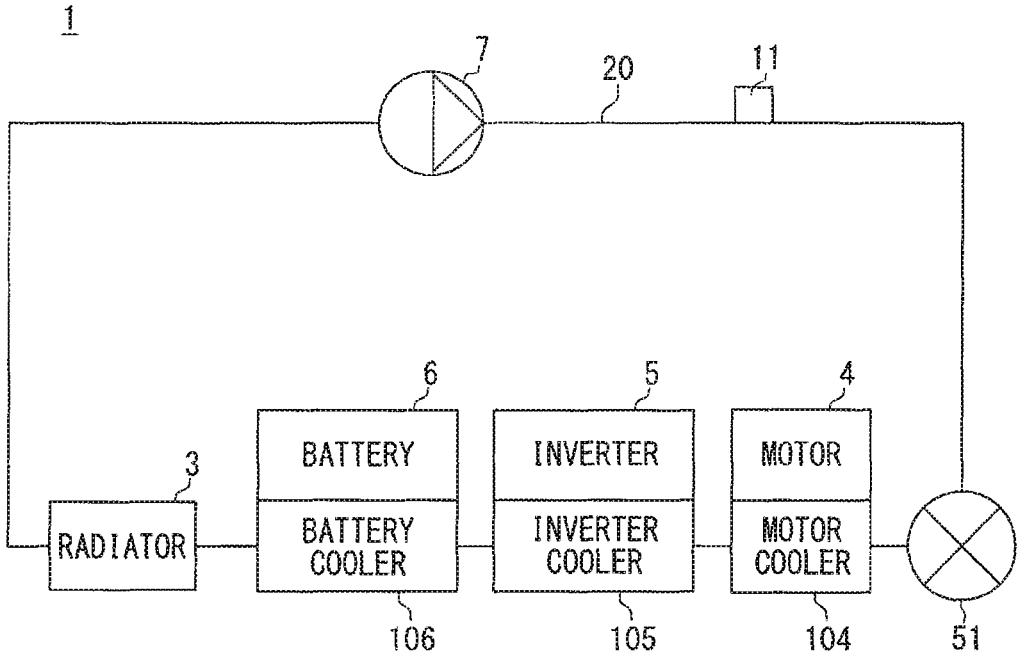
FIG. 8 is a diagram illustrating a heat exchange apparatus according to a third embodiment.

In FIG. 8, the motor cooler 104, the inverter cooler 105, the battery cooler 106, and the radiator 3 are connected in series in this order. In other words, the four heat exchangers are arranged side by side on one common flow path 20 without branching the flow path. The open/close valve 51 is provided upstream of the motor cooler 104. The downstream side of the open/close valve 51 is connected to one inlet opening of the piping forming the flow path. That is, the cooling water discharged from the open/close valve 51 flows into the common flow path 20 connected to the motor cooler 104, and no flow path other than the flow path 20 is formed.

The cooling water converted from the steady flow to the pulsating flow by the open/close valve 51 flows through the common flow path 20 in the order of the motor cooler 104, the inverter cooler 105, and the battery cooler 106, and finally the radiator 3. In other words, the motor cooler 104 receives the largest contribution to improve the heat exchange efficiency due to the pulsating flow. The contribution become smaller in order of the inverter cooler 105 and the battery cooler 106, and the contribution is the smallest for the radiator 3.

Figure 9:
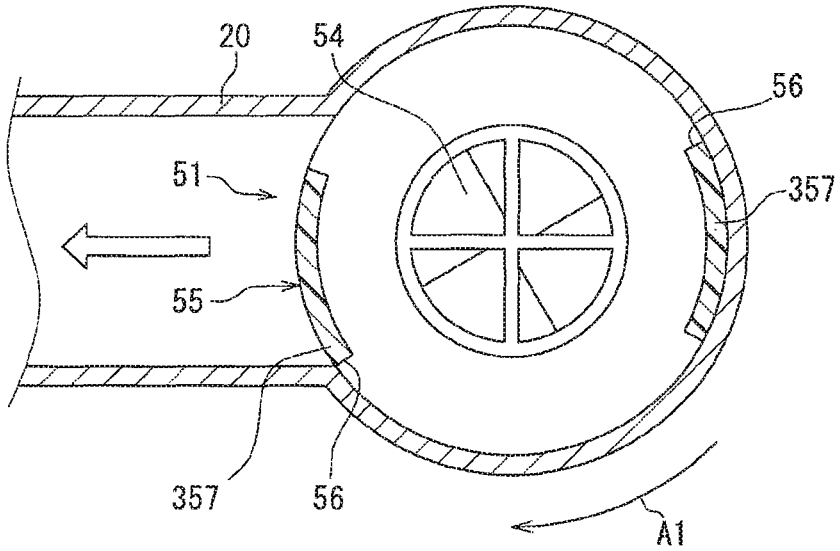
FIG. 9 is a cross-sectional view illustrating an open/close valve of the third embodiment in a throttle state.

In FIG. 9, the open/close valve 51 is provided inside the piping forming the common flow path 20 for the cooling water. In the piping forming the common flow path 20, a piping upstream of the open/close valve 51 and a piping downstream of the open/close valve 51 are connected perpendicularly to each other. In other words, the piping forming the common flow path 20 has an L-shape bent around the open/close valve 51. In the piping forming the common flow path 20, the flow path area is substantially the same between the upstream side and the downstream side of the open/close valve 51.

The open/close valve 51 has two valve lids 357 to limit the flow of cooling water. The valve lids 357 are provided to face each other around the rotation axis of the open/close valve 51. The number of valve lids 357 is not limited to two, and three or more valve lids 357 may be provided.

The size of the valve lid 357 is smaller than the inlet opening of the common flow path 20. That is, even when the inlet opening and the valve lid 357 overlap with each other at the maximum, the valve lid 357 does not completely block the inlet opening. In other words, the valve lid 357 periodically repeats the open state and the throttle state, without the closed state, to generate a pulsating flow.

According to the present embodiment, the heat exchangers are arranged in series. Therefore, the distance from the open/close valve 51, which is a pulsating flow generating device, can be adjusted according to the order in which the heat exchangers are arranged. Therefore, the rate of increasing the heat exchange efficiency can be changed for each heat exchanger. In other words, a heat exchanger can be placed near the open/close valve 51 to mostly raise the heat exchange efficiency, to greatly improve the heat exchange efficiency due to the pulsating flow. In contrast, a heat exchanger is placed at a distance from the open/close valve 51 to raise the flowing speed of the cooling water, to secure a large flow rate using a flow close to a steady flow.

The open/close valve 51 has the plural valve lids 357. Therefore, two cycles of pulsating flow can be generated for one rotation of the open/close valve 51. Thus, the cycle of the pulsating flow of the cooling water sent to the heat exchanger can be adjusted. Accordingly, it is possible to efficiently improve the heat exchange efficiency in the heat exchanger.

The valve lid 357 is smaller than the inlet opening of the common flow path 20. Therefore, the inlet opening can be restricted from being completely closed during operation of the circulation pump 7. Thus, the power to rotate the driving part 54 can be maintained with the flow of the cooling water.

Fourth Embodiment

This embodiment is a modification of the preceding embodiment. In this embodiment, an engine 2 is provided as an object to be cooled, and a pulsating flow of the engine cooling water is supplied to a main heat exchanger 404 and a sub heat exchanger 405.

Figure 10:
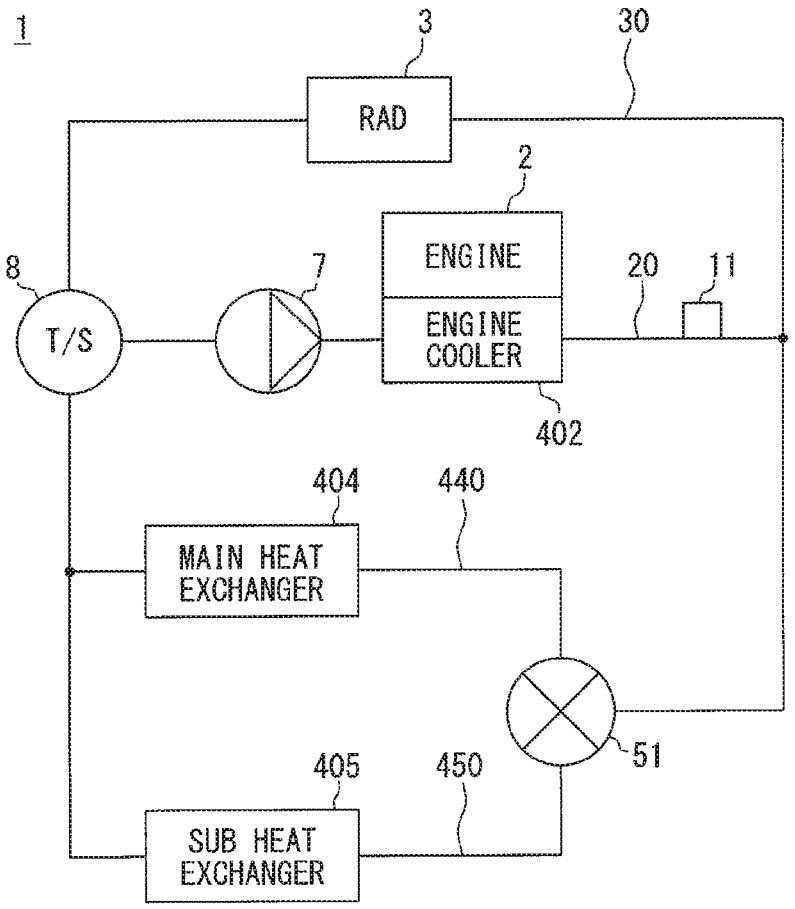
FIG. 10 is a diagram illustrating a heat exchange apparatus according to a fourth embodiment.

In FIG. 10, the heat exchange apparatus 1 includes the engine 2, the radiator 3, the main heat exchanger 404, and the sub heat exchanger 405, which are connected by the flow path. The heat exchange apparatus 1 is a vehicle heat exchange apparatus mounted on a vehicle such as an automobile. The heat exchange apparatus 1 circulates the engine cooling water, which is a heat exchange medium, inside the heat exchange apparatus to perform heat exchange. The object is cooled or heated by heat exchange.

The engine 2 is a heat source that radiates heat to the outside. The engine 2 is provided with an engine cooler 402 that is cooled using the engine cooling water. The flow path area of the engine cooler 402 is larger than that of the other heat exchanger such as the radiator 3. That is, the Reynolds number is large, and the engine cooling water flowing inside the heat exchanger easily becomes a turbulent. The engine cooler 402 has the common flow path 20. The engine cooling water, which is a heat exchange medium used for cooling the engine 2, flows through the common flow path 20.

The circulation pump 7 is provided in the common flow path 20. The water temperature sensor 11 is provided in the common flow path 20. The water temperature sensor 11 is disposed in the vicinity of the outlet of the engine cooler 402 for the engine cooling water. The water temperature sensor 11 is a sensor that measures the temperature of the engine cooling water after passing through the engine cooler 402. When the water temperature measured by the water temperature sensor 11 is high, the output of the circulation pump 7 is raised to promote cooling of the engine cooling water.

The engine 2 and the radiator 3 are connected by the common flow path 20 and a cooling flow path 30 annularly. The radiator 3 is a heat exchanger that cools the engine cooling water by heat exchange between the cooling water and air. A thermostat (T/S) 8 is provided at a connection point between the common flow path 20 and the cooling flow path 30.

The thermostat 8 adjusts the amount of engine cooling water flowing in the cooling flow path 30 based on the temperature of the engine cooling water. In other words, when the temperature of the engine cooling water is low, for example, before completion of warm-up, the engine cooling water is not circulated through the cooling flow path 30 to quickly complete the warm-up. When the temperature of the engine cooling water is high, for example, after completion of warm-up, the engine cooling water is made to flow through the cooling flow path 30. As a result, the temperature of the engine cooling water is lowered by the radiator 3 to prevent the engine 2 from overheating due to insufficient cooling.

The engine 2 and the main heat exchanger 404 are connected by the common flow path 20 and a main heating flow path 440 annularly. The engine 2 and the sub heat exchanger 405 are connected by the common flow path 20 and a sub heating flow path 450 annularly. The main heat exchanger 404 and the sub heat exchanger 405 are connected in parallel with each other. In other words, the cooling water flowing through the common flow path 20 flows through one of the main heating flow path 440 and the sub heating flow path 450, and returns to the common flow path 20 to circulate again. The main heat exchanger 404 and the sub heat exchanger 405 perform heating by heat exchange between the heated engine cooling water and air for air conditioning. In other words, the main heat exchanger 404 and the sub heat exchanger 405 are heat exchangers used for heating.

The main heat exchanger 404 and the sub heat exchanger 405 are parallel flow type heat exchangers. The main heat exchanger 404 and the sub heat exchanger 405 have flat tube piping in which a flow path is defined for the cooling water. The flow path area of the main heat exchanger 404 and the sub heat exchanger 405 is smaller than that of the engine cooler 402. Since the Reynolds number is small, the fluid flowing through the pipe with the small flow path area tends to be in a laminar flow state. Inner fins are formed inside the piping through which the cooling water circulates, in the main heat exchanger 404 and the sub heat exchanger 405. The main heat exchanger 404 and the sub heat exchanger 405 are not limited to the parallel flow type heat exchangers. For example, a fin tube type heat exchanger or a serpentine type heat exchanger may be used.

The open/close valve 51 is position at a connection point among the common flow path 20, the main heating flow path 440, and the sub heating flow path 450, upstream of the main heating flow path 440 and the sub heating flow path 450. The open/close valve 51 is provided between the engine cooler 402 and the heat exchanger 404, 405. In other words, the open/close valve 51 is provided downstream of the engine cooler 402 and upstream of the heat exchanger 404, 405. The open/close valve 51 is provided at a position closer to the heat exchanger 404, 405 than the engine cooler 402.

The open/close valve 51 is provided inside a pipe forming a flow path for the engine cooling water. The open/close valve 51 is provided inside the piping at which the three flow paths, i.e., the common flow path 20, the main heating flow path 440, and the sub heating flow path 450 intersect and are connected with each other. The main heating flow path 440 and the sub heating flow path 450 are provided to oppose each other and to be extended in opposite directions. The flow path area is substantially the same among the piping forming the common flow path 20, the piping forming the main heating flow path 440, and the piping forming the sub heating flow path 450.

The open/close valve 51 switches the cooling water to flow through the main heating flow path 440 or the sub heating flow path 450. That is, when the flow path to the main heating flow path 440 is opened, the open/close valve 51 closes the flow path to the sub heating flow path 450. On the other hand, the open/close valve 51 opens the flow path to the sub heating flow path 450 when the flow path to the main heating flow path 440 is closed. In other words, the open/close valve 51 switches the flow paths so that the cooling water flows to the two flow paths, i.e., the main heating flow path 440 and the sub heating flow path 450, at different timings.

The flow path is opened and closed by the rotation of the open/close valve 51 at the inlet opening of the pipe forming the main heating flow path 440 and the inlet opening of the pipe forming the sub heating flow path 450. In other words, the three states, i.e., the open state, the closed state, and the throttle state are periodically repeated.

When the open/close valve 51 changes from the closed state to the open state via the throttle state, the speed of the cooling water flowing through the inside of the pipe is accelerated as approaching the open state. On the other hand, when the open/close valve 51 changes from the open state to the closed state via the throttle state, the speed of the cooling water flowing through the inside of the pipe is decelerated as approaching the closed state. In this way, the inlet opening is periodically shifted among the three states, i.e., the open state, the throttle state, and the closed state by rotating the open/close valve 51 inside the piping, for each flow path. That is, the flow velocity of the cooling water flowing through each flow path is periodically changed to generate a pulsating flow.

The open/close valve 51 supplies a pulsating flow of the engine cooling water to the main heat exchanger 404 and the sub heat exchanger 405. The open/close valve 51 supplies the pulsating flows having different phases to the main heat exchanger 404 and the sub heat exchanger 405. In other words, when the engine cooling water does not flow into the main heat exchanger 404, the engine cooling water flows into the sub heat exchanger 405. On the other hand, when the engine cooling water does not flow into the sub heat exchanger 405, the engine cooling water flows into the main heat exchanger 404. That is, pulsating flows with opposite phases are respectively supplied to the main heat exchanger 404 and the sub heat exchanger 405.

There is no timing that the engine cooling water is not supplied to the main heat exchanger 404 nor the sub heat exchanger 405. In other words, when the circulation pump 7 is active, the engine cooling water flows to the main heat exchanger 404 or/and the sub heat exchanger 405. That is, the open/close valve 51 does not simultaneously close the main heating flow path 440 and the sub heating flow path 450.

According to the present embodiment, the open/close valve 51 is provided between the engine cooler 402 and the heat exchanger 404, 405, at a position closer to the heat exchanger 404, 405 than the engine cooler 402. Therefore, the engine cooling water delivered from the circulation pump 7 flows inside the engine cooler 402 in a steady flow state. Thus, it is possible to secure a large flow rate of the engine cooling water at the engine cooler 402 and the piping portion where a high heat exchange efficiency is not required.

The open/close valve 51 supplies pulsating flows of different phases to the main heat exchanger 404 and the sub heat exchanger 405. Therefore, the flow rate of the engine cooling water can be easily maintained constant in the entire heat exchange apparatus 1.

There is no situation that the engine cooling water does not circulate in both of the heat exchangers, i.e., the main heat exchanger 404 and the sub heat exchanger 405. Therefore, the engine cooling water circulates somewhere during operation of the circulation pump 7. Therefore, the power for rotating the driving part 54 can be restricted from being run out by a stop in the flow of the engine cooling water.

The main heat exchanger 404 and the sub heat exchanger 405 need not be separate from each other. That is, two flow paths for engine cooling water may be provided for the same heat exchanger. In this case, pulsating flows with the phases shifted from each flow by a half of the cycle are supplied to the respective paths. Accordingly, it is possible to enjoy the improvement in the heat exchange efficiency by the pulsating flow at two places in one heat exchanger. Therefore, the heat exchanger can be downsized. The number of flow paths for the engine cooling water in the same heat exchanger is not limited to two, and three or more pulsating flows may be introduced.

Fifth Embodiment

This embodiment is a modification of the preceding embodiment. In this embodiment, a rotation driving body 553 including the driving part 54 is separable from the open/close valve 551. In addition, the open/close valve 551 and the driving part 54 rotate about a rotation shaft portion 559.

Figure 11:
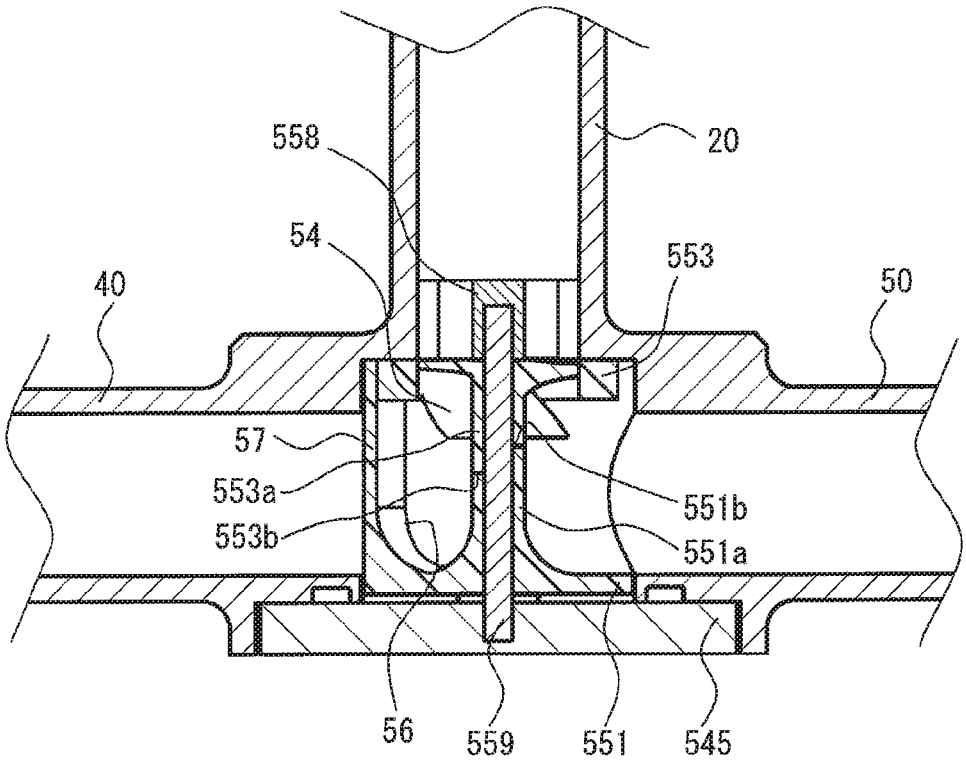
FIG. 11 is a view illustrating an open/close valve 51 according to a fifth embodiment attached to a piping.

In FIG. 11, the rotation driving body 553 having the driving part 54, and the open/close valve 551 are located in a connection among the common flow path 20, the motor flow path 40 and the inverter flow path 50. The rotation driving body 553 includes a driving side tube portion 553*a* extending along the rotation axis of the rotation driving body 553. An end portion of the driving side tube portion 553*a* has a driving side key shaped portion 553*b*. The open/close valve 551 includes an open/close valve side tube portion 551*a* extending along the rotation axis of the open/close valve 551. An end portion of the open/close valve side tube portion 551*a* has an open/close valve side key shaped portion 551*b*.

The rotation driving body 553 and the open/close valve 551 are separate parts. The driving side key shaped portion 553*b* of the rotation driving body 553 and the open/close valve side key shaped portion 551*b* of the open/close valve 551 are engaged with each other such that the rotation driving body 553 and the open/close valve 551 are connected with each other. The rotation driving body 553 is located upstream of the open/close valve 551 in the flow of fluid, e.g., cooling water.

The rotation shaft portion 559 penetrates the rotation driving body 553 and the open/close valve 551. The rotation shaft portion 559 provides a rotation shaft when the rotation driving body 553 and the open/close valve 551 rotate. That is, both of the rotation driving body 553 and the open/close valve 551 are rotating bodies which rotate about the rotation shaft portion 559 as a rotation axis. Therefore, the rotation driving body 553 having the driving part 54 and the open/close valve 551 are coaxial with each other as the rotation axis.

A cover 545 is provided across the motor flow path 40 and the inverter flow path 50. The cover 545 is a cover member for covering an opening provided in the flow path from the outer side so as to prevent the leakage of the cooling water, while the opening is defined to install the components such as the rotation driving body 553 and the open/close valve 551 inside the flow path for the cooling water. The cover 545 has a recess for holding the rotation shaft portion 559. The common flow path 20 has a shaft holding portion 558 for holding the rotation shaft portion 559. The shaft holding portion 558 has a tubular shape in which the rotation shaft portion 559 can be inserted and held therein. One end of the rotation shaft portion 559 in the longitudinal direction of the rotation shaft portion 559 is held by the shaft holding portion 558 of the common flow path 20, and the other end is held by the recess defined in the cover 545.

Figure 12:
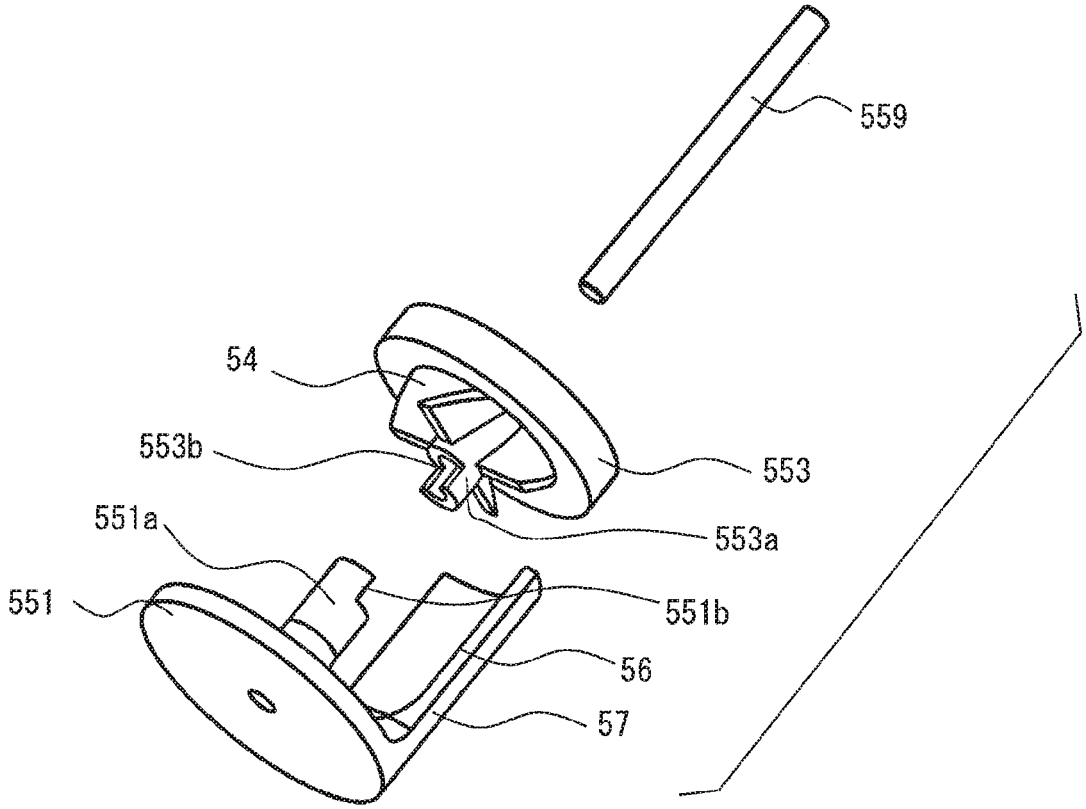
FIG. 12 is an exploded view illustrating the open/close valve of the fifth embodiment.

In FIG. 12, the open/close valve 551 has the valve lid 57 shaped in a curved plate so that distances from the rotation shaft are equal to each other. The valve lid 57 and the open/close valve 551 form a continuous one-piece component. Further, the valve lid 57 is a body separable from the rotation driving body 553.

The rotation shaft portion 559 has a cylindrical shape. The open/close valve side tube portion 551*a* has a cylindrical shape extending along the rotation shaft portion 559. The outer diameter of the rotation shaft portion 559 and the inner diameter of the open/close valve side tube portion 551*a* are substantially equal with each other. The open/close valve side key shaped portion 551*b* is not cylindrical, but shaped in semicircular.

The rotation driving body 553 has a ring portion shaped annular around the driving part 54. The ring portion of the rotation driving body 553 and the driving part 54 are integrally formed continuously. The driving side tube portion 553*a* has a cylindrical shape extending along the rotation shaft portion 559. The outer diameter of the rotation shaft portion 559 and the inner diameter of the driving side tube portion 553*a* are substantially equal with each other. The driving side key shaped portion 553*b* is not cylindrical, but shaped in semicircular.

Figure 13:
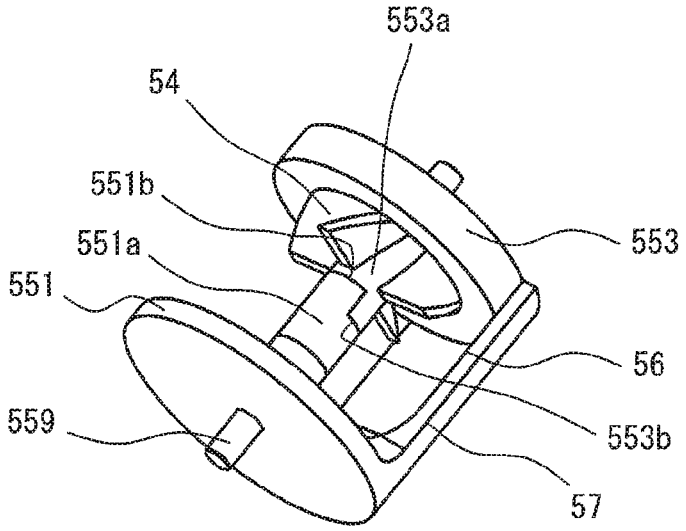
FIG. 13 is a perspective view illustrating the open/close valve of the fifth embodiment.

In FIG. 13, the rotation shaft portion 559 is inserted into the open/close valve side tube portion 551*a* and the driving side tube portion 553*a*. The rotation shaft portion 559 penetrates the open/close valve 551 and the rotation driving body 553, and both end portions of the rotation shaft portion 559 protrude outward. A part of the valve lid 57 is located on the outer side of the rotation driving body 553 in the radial direction.

The semicircular shape of the open/close valve side key shaped portion 551*b* and the semicircular shape of the driving side key shaped portion 553*b* are engaged with each other. In this state, the open/close valve 551 and the rotation driving body 553 are engaged with each other. That is, a rotating force generated in the driving part 54 upon receiving the force of the flow of cooling water is transmitted to the open/close valve 551.

However, the way of transmitting the force of the driving part 54 to the open/close valve 551 is not limited to the engagement between the driving side key shaped portion 553*b* and the open/close valve side key shaped portion 551*b*. For example, a driving force transmitting portion for transmitting a driving force may be provided as a separate part between the rotation driving body 553 and the open/close valve 551. In this case, it is possible to form an easily wear-out part which is brought in contact with the rotation shaft portion 559 as a separate part made of, for example, metal having high wear resistance. In addition, the shape of the open/close valve side key shaped portion 551*b* and the driving side key shaped portion 553*b* is not limited to the semicircular shape. For example, plural irregularities, like gears, may be provided for the engagement. Alternatively, a helical groove and a helical protrusion, like a screw, may be provided, to connect the open/close valve 551 and the rotation driving body 553 by rotation.

Figure 14:
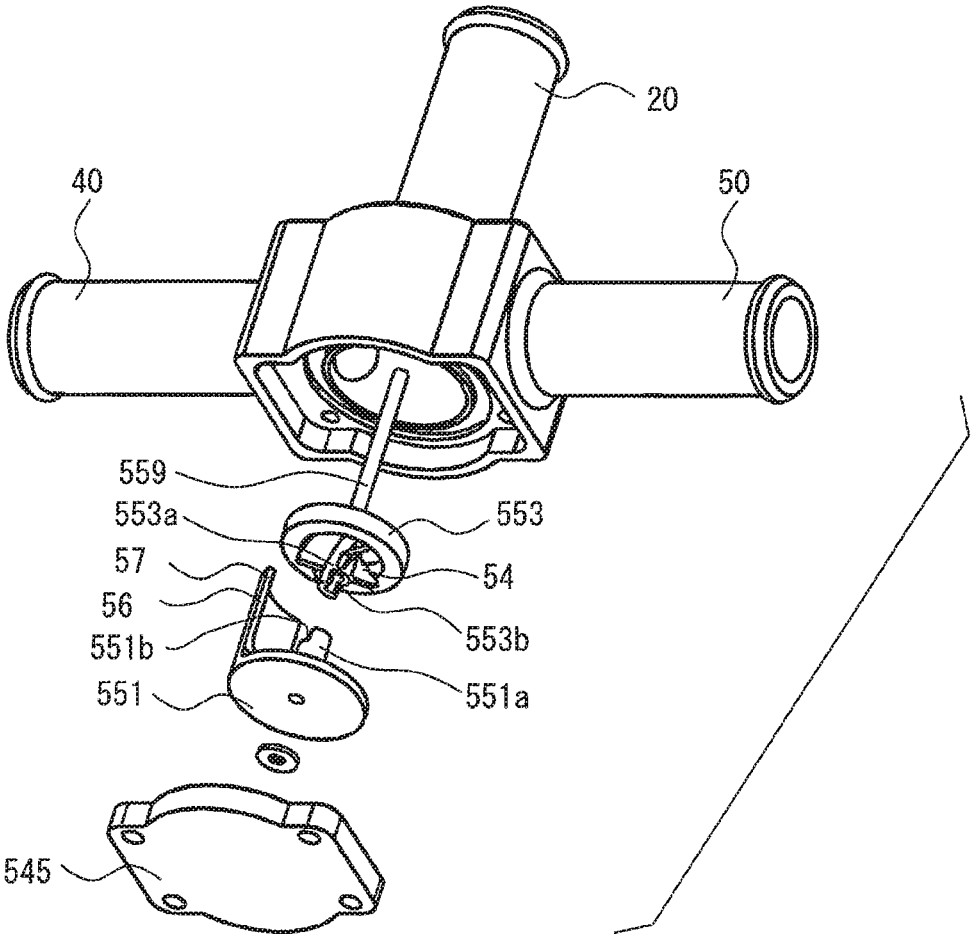
FIG. 14 is an exploded view illustrating a peripheral structure of the open/close valve of the fifth embodiment.

A method of installing the driving part 54 and the open/close valve 551 in the heat exchange apparatus 1 will be described below. In FIG. 14, the rotation shaft portion 559 is inserted into a connection among the common flow path 20, the motor flow path 40, and the inverter flow path 50. The rotation shaft portion 559 is inserted into the shaft holding portion 558 of the common flow path 20. The rotation shaft portion 559 appropriately held by the shaft holding portion 558 is located at a position approximately equal to the central axis of the common flow path 20 shaped cylindrical.

Thereafter, the rotation driving body 553, the open/close valve 551, and a washer are inserted in this order into the rotation shaft portion 559. The rotation shaft portion 559 provides the rotation shaft for both of the rotation driving body 553 and the open/close valve 551. In other words, the rotation shaft of the rotation driving body 553 and the rotation shaft of the open/close valve 551 are coaxial. After confirming that all parts are properly arranged, the cover 545 is placed to cover from the outermost side and screwed. A ring-shaped sealing member may be provided between the cover 545 and the piping so as to prevent the cooling water from leaking out of the heat exchange apparatus 1 more accurately.

Figure 15:
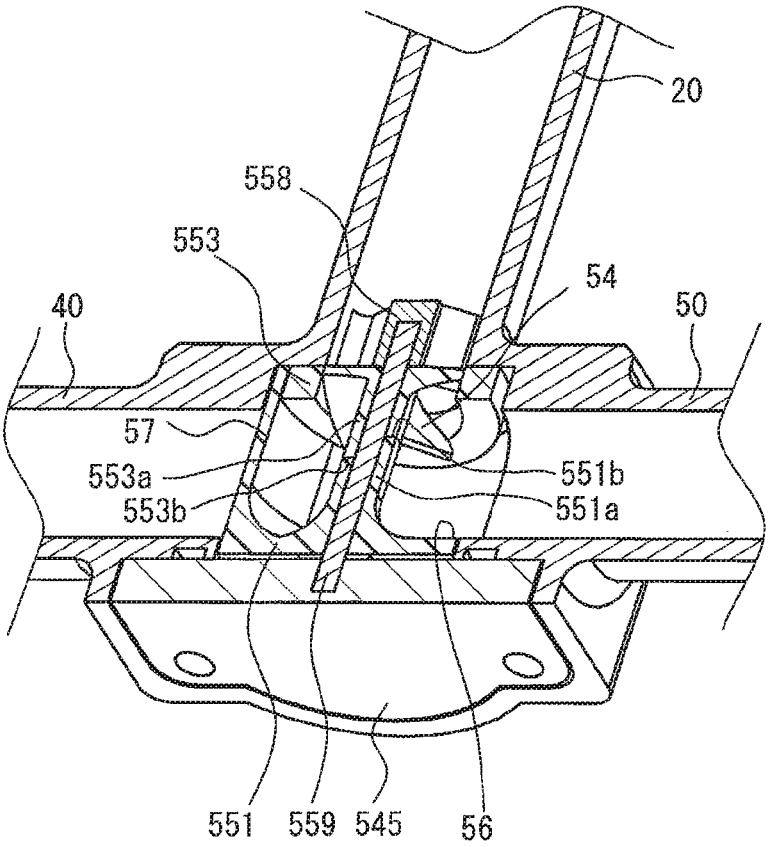
FIG. 15 is a cross-sectional perspective view illustrating the peripheral structure of the open/close valve of the fifth embodiment.

FIG. 15 illustrates the driving part 54 and the open/close valve 551 installed at proper positions. One end portion of the rotation shaft portion 559 is inserted into the shaft holding portion 558 without a gap. The other end portion of the rotation shaft portion 559 is inserted into the cover 545 without a gap. That is, the both end portions of the rotation shaft portion 559 are firmly held, and the rotation shaft portion 559 is fixed not movable from the normal position.

The rotation driving body 553 is in contact with the piping forming the common flow path 20 without a gap. Therefore, the cooling water cannot pass between the pipe and the rotation driving body 553, and flows inside of the rotation driving body 553. In other words, the cooling water flows while contacting the driving part 54 and applying a force to rotate the driving part 54.

The driving side key shaped portion 553*b* and the open/close valve side key shaped portion 551*b* are properly engaged with each other. That is, the distal end surface of the driving side tube portion 553*a* and the distal end surface of the open/close valve side tube portion 551*a* overlap each other and are in contact with each other. In this state, the rotation driving body 553 receives the force of the flow of the cooling water and rotates, whereby the open/close valve 551 also rotates integrally.

A slight gap is formed between the driving side tube portion 553*a* and the rotation shaft portion 559. A slight gap is formed between the open/close valve side tube portion 551*a* and the rotation shaft portion 559. Therefore, the rotation shaft portion 559 does not rotate in a state where the rotation driving body 553 and the open/close valve 551 rotate integrally. However, it is not necessary to form a gap between the rotation shaft portion 559 and the driving side tube portion 553*a* and a gap between the rotation shaft portion 559 and the open/close valve side tube portion 551*a*. In this case, both ends of the rotation shaft portion 559 are not rigidly held by the shaft holding portion 558 and the cover 545, but are configured to function as bearings that support with a slight clearance. Thus, when the rotation driving body 553 and the open/close valve 551 rotate together, the rotation shaft portion 559 rotates integrally with the rotation driving body 553 and the open/close valve 551.

The washer is disposed between the open/close valve 551 and the cover 545. Further, a clearance is formed between the open/close valve 551 and the cover 545 in a portion where the washer is not disposed. Therefore, when the open/close valve 551 rotates, the open/close valve 551 and the cover 545 are not brought into direct contact with each other.

The semicircular portion of the open/close valve side tube portion 551*a* forming the open/close valve side key shaped portion 551*b* is located on a side opposite from the valve lid 57. In other words, the open/close valve side tube portion 551*a* extends longer along the rotation shaft portion 559 on the side opposite from the valve cover 57 than a side adjacent to the valve cover 57. The semicircular portion of the driving side tube portion 553*a* forming the driving side key shaped portion 553*b* is provided adjacent to the valve lid 57, and the driving side tube portion 553*a* extends longer along the rotation shaft portion 559. A contact area between the open/close valve side tube portion 551*a* and the rotation shaft portion 559 is larger than a contact area between the driving side tube portion 553*a* and the rotation shaft portion 559. Particularly, in the portion located on the side opposite from the valve lid 57, the contact area between the open/close valve side tube portion 551*a* and the rotation shaft portion 559 is larger than the contact area between the driving side tube portion 553*a* and the rotation shaft portion 559.

When the open/close valve 551 closes the motor flow path 40 or the inverter flow path 50, since the flow of the cooling water is restricted by the valve lid 57, the pressure temporarily increases at the upstream side in the flow of the cooling water, in the vicinity of the valve lid 57, than the downstream side. That is, the valve lid 57 receives a force in a direction to be pressed against the wall surface of the piping. In other words, the open/close valve 551 having the valve lid 57 receives a force in the direction from the rotation shaft portion 559 to the valve lid 57. On the other hand, the open/close valve side tube portion 551*a* receives a reaction force from the rotation shaft portion 559. The reaction force is a force in a direction opposite to the force from the rotation shaft portion 559 toward the valve lid 57. As a result, the open/close valve 51 keeps rotating at the proper position while the two forces are balanced. The reaction force generated in the open/close valve side tube portion 551*a* concentrates on a part of the open/close valve side tube portion 551*a* located on the side opposite from the valve lid 57. Therefore, it is useful to make the open/close valve side tube portion 551*a* to be long along the rotation shaft portion 559 in order to ensure a large contact area between the open/close valve side tube portion 551*a* and the rotation shaft portion 559 on the side opposite from the valve lid 57.

According to the present embodiment, the open/close valve 551 and the driving part 54 are separate parts. Therefore, the number of revolutions at the open/close valve 551 can be adjusted by changing the rotation driving body 553 having the driving part 54 according to the driving force necessary for rotating the open/close valve 551. In addition, since the open/close valve 551 and the driving part 54 are not formed integrally, it is easy to make the components simple. That is, it is easy to reduce the manufacturing cost with the simple shape of each component.

The rotation shaft portion 559 is provided to coaxialize the rotating shaft of the driving part 54 and the rotating shaft of the open/close valve 551. Therefore, the rotation of the driving part 54 can be directly transmitted to the open/close valve 551 to rotate the open/close valve 551. Therefore, the number of components can be reduced, compared to a case where the rotating shaft of the open/close valve 551 and the rotating shaft of the driving part 54 are provided at positions not coaxial while the rotation force of the driving part 54 is transmitted to the open/close valve 551 by using another component such as a gear. Thus, it is easy to downsize the heat exchange apparatus 1.

Further, the rotation of the open/close valve 551 and the rotation driving body 553 can be stabilized, as compared with the case where the rotation shaft portion 559 is not provided. Therefore, the rotation of the open/close valve 551 and the rotation driving body 553 is stabilized, and wear of the open/close valve 551 and the rotation driving body 553 due to the contact with the wall surface of the piping is easily reduced. Furthermore, since friction caused by the contact with the wall surface due to rotation can be reduced, the open/close valve 551 can be rotated with a small driving force. Therefore, it is possible to reduce the size of the driving part 54 and to reduce the resistance generated by the driving part 54 in the flow of the cooling water.

The open/close valve 551 has the open/close valve side tube portion 551*a* extending along the rotation shaft portion 559. Therefore, the force generated between the open/close valve 551 and the rotation shaft portion 559 can be received by the open/close valve side tube portion 551*a* in order to maintain the regular position of the open/close valve 551. That is, the contact area between the open/close valve 551 and the rotation shaft portion 559 can be secured large, as compared with the case where the open/close valve side tube portion 551*a* is not formed. Therefore, a force generated between the rotation shaft portion 559 and the open/close valve 551 can be received over a wide area to disperse the force. Therefore, it is possible to suppress breakage and wear of the open/close valve 551 caused by a large force locally applied to the open/close valve 551. Therefore, the open/close valve 551 can be rotated stably to periodically increase and decrease the flow speed.

The outer diameter of the rotation shaft portion 559 may be made different depending on the position. For example, a stepped shape may be formed such that the outer diameter of a portion in contact with the open/close valve side tube portion 551*a* is made larger than the outer diameter of a portion in contact with the driving side tube portion 553*a*. Accordingly, it is easy to secure a large contact area between the rotation shaft portion 559 and the open/close valve side tube portion 551*a*. Therefore, the reaction force generated in the open/close valve 551 can be received by the open/close valve side tube portion 551*a* with a large area. For this reason, it is possible to suppress locally severe abrasion as compared with a case where the reaction force is received with a narrow area. Therefore, the open/close valve 551 can be used stably over a long period of time.

Sixth Embodiment

This embodiment is a modification of the preceding embodiment. In this embodiment, the rotation driving body 653 having the driving part 54 is separable from the open/close valve 651.

Figure 16:
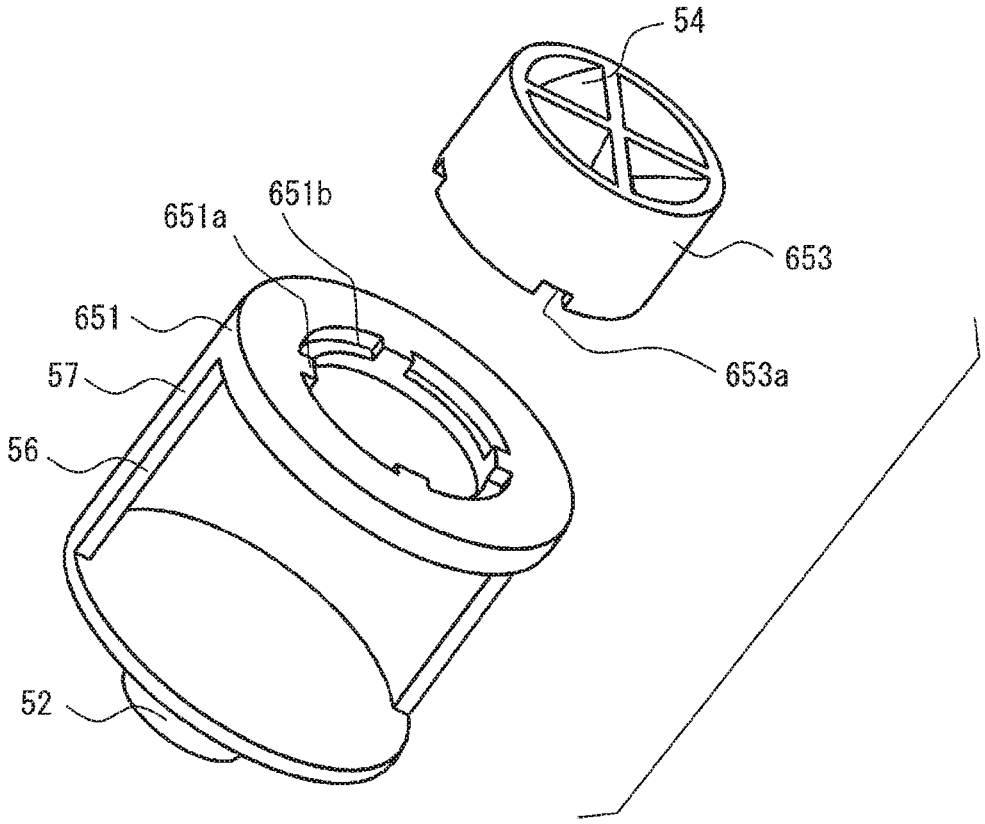
FIG. 16 is an exploded view illustrating an open/close valve according to a sixth embodiment.

In FIG. 16, the rotation driving body 653 has a cylindrical shape housing the driving part 54. The end portion of the rotation driving body 653 has a fitting recess 653*a* at four positions.

The open/close valve 651 has an annular recess 651*b* having an annular shape. The outer diameter of the annular recess 651*b* is substantially equal to the outer diameter of the end portion of the rotation drive body 653 where the fitting recess 653*a* is provided. The annular recess 651*b* has a fitting protrusion 651*a* at four places.

Figure 17:
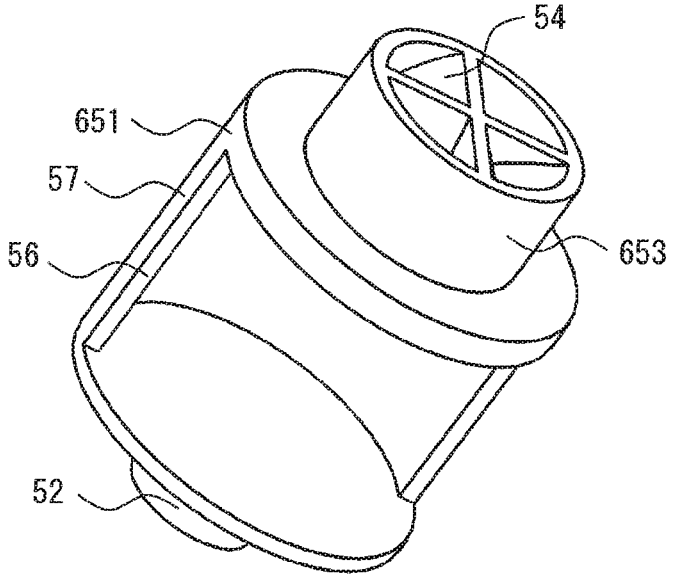
FIG. 17 is a perspective view illustrating the open/close valve of the sixth embodiment.

In FIG. 17, a part of the rotation driving body 653 is inserted into the annular recess 651*b*, and the open/close valve 651 and the rotation driving body 653 are made into one-piece component. The fitting protrusion 651*a* and the fitting recess 653*a* are fitted with each other in a state where the open/close valve 651 and the rotation driving body 653 are made into one-piece component. In this state, the fitting protrusion 651*a* and the fitting recess 653*a* are not exposed to the outside.

When the driving part 54 rotates by receiving a force from the flow of the cooling water, the rotation driving body 653 which is an integral part continuous with the driving part 54 rotates. When the rotation driving body 653 rotates, the rotating force is transmitted from the fitting recess 653*a* to the fitting protrusion 651*a*. The open/close valve 651 which is an integral part continuous with the fitting protrusion 651*a* is rotated by the force transmitted to the fitting protrusion 651*a*. As a result, the open/close valve 651 exerts a function of increasing or decreasing the flow velocity of the cooling water.

According to the present embodiment, the force received by the driving part 54 is transmitted by the fitting between the plural fitting protrusions 651*a* and the plural fitting recesses 653*a*. For this reason, it is easier to disperse the force, as compared with the case where the force is transmitted to only one specific location. Therefore, it is easy to prevent breakage of the open/close valve 651 and the rotation driving body 653 at specific portions due to the concentration of the force.

Seventh Embodiment

This embodiment is a modification of the preceding embodiment. In this embodiment, a unit of the open/close valve 51 and the driving part 54 are disposed inside an inlet side header tank 31 of the radiator 3.

Figure 18:
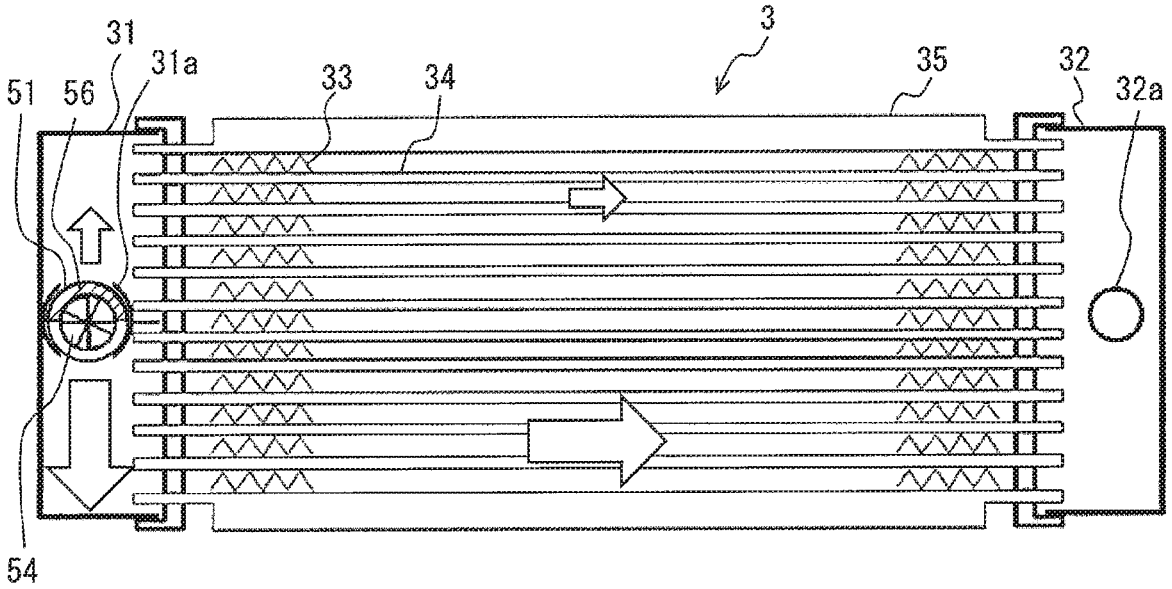
FIG. 18 is a schematic view illustrating a heat exchange apparatus according to a seventh embodiment.

In FIG. 18, the radiator 3 has a core portion 35. The core portion 35 includes tubes 34 and fins 33 alternately stacked with each other in the vertical direction.

A pair of header tanks 31, 32 extending in the tube stacking direction is disposed at both end portions of each tube 34 in the tube longitudinal direction. An interior space is formed in the header tank 31, 32. One of the header tanks defines the inlet side header tank 31. The inlet side header tank 31 has an inlet port 31*a*. The other header tank defines an outlet side header tank 32. An outlet port 32*a* is provided in the outlet side header tank 32. The unit of the open/close valve 51 and the driving part 54 is disposed inside the inlet side header tank 31 of the radiator 3 and is provided at a position corresponding to the inlet port 31*a*.

The unit of the open/close valve 51 and the driving part 54 may be disposed inside the outlet side header tank 32. In this case, the unit of the open/close valve 51 and the driving part 54 may be provided at a position corresponding to the outlet port 32*a*, or may be provided at other positions.

As the distance from the open/close valve 51, which is a pulsating flow generating device, is shorter, the improvement in the heat exchange efficiency due to the pulsating flow becomes larger. The improvement becomes smaller as the distance from the open/close valve 51 becomes larger. Therefore, in the present embodiment, the effect of improving the heat exchange efficiency of the radiator 3 is obtained by the unit of the open/close valve 51 and the driving part 54 arranged inside the header tank.

Other Embodiments

The disclosure in this specification is not limited to the illustrated embodiment. The disclosure encompasses the illustrated embodiments and modifications by those skilled in the art based thereon. For example, the disclosure is not limited to the parts and/or combinations of elements shown in the embodiments. The disclosure can be implemented in various combinations. The disclosure may have additional parts that may be added to the embodiment. The disclosure encompasses omissions of parts and/or elements of the embodiments. The disclosure encompasses replacement or combination of parts and/or elements between one embodiment and another. The disclosed technical scope is not limited to the description of the embodiment. Several technical ranges disclosed are indicated by the description of the claims and should be understood to include all modifications within meaning and scope equivalent to the description of the claims.

The driving part 54 is not limited to the water wheel structure that receives the force of the cooling water flow. That is, the rotational energy associated with driving of the circulation pump 7 may be taken out. For example, a pump gear may be provided to be exposed to the outside of the circulation pump 7, and interlocks with the drive of the circulation pump 7. In this case, the driving force is transmitted from the pump gear to the open/close valve 51 by using power transmission parts such as other gears and shafts. According to this, the drive of the circulation pump 7 and the drive of the open/close valve 51 can be made common. In other words, it is possible to interlock the driving of the circulation pump 7 for making the flow and the open/close valve 51 for converting to the flow into the pulsating flow. Therefore, the control flow can be simplified as compared with the case where the open/close valve 51 is independently controlled.

The open/close valve 51 is not limited to a valve having a rotation axis parallel to the flow direction of the cooling water. For example, a butterfly valve having a rotating shaft perpendicular to the flow direction of the cooling water may be used.

The open/close valve 51 is not limited to a valve that opens and closes the inlet opening by the valve lid 57 shaped in cylindrical, and may be a ball valve that rotates a spherical valve inside a flow path to open and close the inlet opening.

What is claimed is:

1. A heat exchange apparatus comprising:

a heat exchanger through which a heat exchange medium flows;

a pump that causes the heat exchange medium to flow through the heat exchanger;

a flow path through which the heat exchange medium flows, the flow path connecting the heat exchanger and the pump with each other;

a flow rate controller provided in the flow path to raise or lower a flow velocity of the heat exchange medium flowing through the flow path; and a turbine having a cylindrical rotation driving body housing a driving part provided in the flow path to drive the flow rate controller by a flow of the heat exchange medium flowing through the flow path, wherein the heat exchanger includes a plurality of tubes and a header tank that extends in a stacking direction in which the plurality of tubes are stacked and that is disposed in an end of the plurality of tubes in a longitudinal direction of the plurality of tubes, the flow rate controller and the turbine are disposed in the header tank, the flow rate controller has a rotational axis perpendicular to the longitudinal direction of the plurality of tubes, the flow rate controller includes an open/close valve, the open/close valve has a valve opening allowing the heat exchange medium to flow, and accelerates or decelerates the flow of the heat exchange medium by increasing or decreasing an open area of the valve opening, the turbine receives a force from the flow of the heat exchange medium flowing through the flow path to rotate, and drives the open/close valve to rotate, and the turbine and the open/close valve are coaxial with each other.

2. The heat exchange apparatus according to claim 1, wherein the flow rate controller is located at a position closer to the heat exchanger than the pump.

3. The heat exchange apparatus according to claim 1, wherein the turbine and the open/close valve are connected with each other by engagement between a driving side key shaped portion of the turbine and an open/close valve side key shaped portion of the open/close valve, and the turbine converts a fluid energy, which is a force of the heat exchange medium flowing through the open/close valve, into torque to drive the open/close valve to rotate integrally with the turbine.

4. The heat exchange apparatus according to claim 1, wherein the turbine is provided integrally with the open/close valve.

5. The heat exchange apparatus according to claim 1, wherein a rotation axis of the turbine and a rotation axis of the open/close valve are coaxial with each other.

6. The heat exchange apparatus according to claim 3, wherein the heat exchanger includes a first heat exchanger and a second heat exchanger connected in parallel to each other, the flow path has a first flow path connected to the first heat exchanger, and a second flow path connected to the second heat exchanger, and the open/close valve switches the heat exchange medium to flow through the first flow path or the second flow path.

7. The heat exchange apparatus according to claim 6, wherein the open/close valve causes the heat exchange medium to have a phase shifted by a half of a period between a flow passing through the first heat exchanger and a flow passing through the second heat exchanger.

8. The heat exchange apparatus according to claim 6, wherein the open/close valve does not simultaneously close the first flow path and the second flow path.

9. The heat exchange apparatus according to claim 1, wherein the turbine has a water wheel structure that rotates by receiving a force from a flow of the heat exchange medium.

10. The heat exchange apparatus according to claim 1, wherein the heat exchanger is a cooler configured to cool an electronic component.

11. The heat exchange apparatus according to claim 1, wherein an engine cooler is arranged in the flow path to cool an engine, and a flow rate of the heat exchange medium flowing through the engine cooler is made constant, and a flow rate of the heat exchange medium flowing through the heat exchanger is periodically increased or decreased.

12. The heat exchange apparatus according to claim 3, further comprising:

a rotation shaft portion coaxial with a tube portion of the turbine and a tube portion of the open/close valve, wherein a contact area between the tube portion of the open/close valve and the rotation shaft portion is larger than a contact area between the tube portion of the turbine and the rotation shaft portion.

13. The heat exchange apparatus according to claim 1, wherein the flow rate controller generates a pulsating flow.

14. The heat exchange apparatus according to claim 1, wherein a rotation shaft portion is perpendicular to both the stacking direction and the longitudinal direction of the plurality of tubes.

15. The heat exchange apparatus according to claim 14, wherein the pump is located outside of the header tank, and the turbine and the open/close valve are located at a center of the header tank in the stacking direction.

* * * * *